US007543578B2

(12) United States Patent
Czimmek

(10) Patent No.: US 7,543,578 B2
(45) Date of Patent: Jun. 9, 2009

(54) HIGH FREQUENCY IGNITION ASSEMBLY

(75) Inventor: Perry R. Czimmek, Williamsburg, VA (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 3 days.

(21) Appl. No.: 11/745,570

(22) Filed: May 8, 2007

(65) Prior Publication Data

US 2008/0276905 A1 Nov. 13, 2008

(51) Int. Cl.
*F02P 3/08* (2006.01)

(52) U.S. Cl. ..... 123/606; 123/596

(58) Field of Classification Search ..... 123/596, 123/606

See application file for complete search history.

(56) References Cited

U.S. PATENT DOCUMENTS 3,906,919 A * 9/1975 Asik et al. ..... 123/598
4,418,660 A 12/1983 Endo
4,833,369 A * 5/1989 White ..... 315/209 T
4,998,526 A 3/1991 Gokhale
5,473,502 A * 12/1995 Bonavia et al. ..... 361/256
5,754,011 A * 5/1998 Frus et al. ..... 315/209 SC
6,104,143 A 8/2000 Bonavia
2002/0101188 A1 8/2002 Frus

FOREIGN PATENT DOCUMENTS

DE 20011584 U1 9/2000
GB 762015 A 11/1956

* cited by examiner

*Primary Examiner*—Erick Solis

(57) ABSTRACT

An ignition assembly includes a power converter receiving an alternating current input, including a first capacitor and a second capacitor. The first capacitor and the second capacitor are charged in parallel to a first DC voltage and at a first polarity to discharge in series to an output at a second DC voltage that is greater than the first DC voltage. The second DC voltage is coupled to an ignition gap, and causes the ignition gap to ionize and form a spark. A switch is coupled to the first capacitor and is operable to control the discharge of the first capacitor and the second capacitor. An AC input switch is coupled to the AC input and is operable to control a flow of current from the AC input through the first capacitor and the second capacitor to the output. The flow of AC to the output sustains the ionization of the ignition gap.

15 Claims, 6 Drawing Sheets

HIGH FREQUENCY IGNITION ASSEMBLY

BACKGROUND OF THE INVENTION

This application relates generally to vehicle ignition systems, and, more particularly, to a high frequency ignition assembly.

Internal combustion engines are used in many applications, including automobiles. In an automotive application, it is desirable for an internal combustion engine to provide improved driveability and increased fuel economy. A conventional internal combustion engine typically operates with poor combustion cycle-to-cycle repeatability due to variation in a flame kernel formation time after ignition, and consequent flame front propagation times. At high speeds and loads, cycle-to-cycle variation is fairly uniform. However at idle speeds and low loads, torque variation and vibration caused by variations in flame kernel formation may be more noticeable.

A radio frequency (RF) resonator can be used as a spark plug to reduce variations in flame kernel formation. A typical resonator consists of an inductor and a capacitor coupled in series to resonate and build a voltage at resonance until an ignition gap ionizes to form a spark. RF resonator spark plugs, however, require expensive materials and are prone to fouling and accumulation of deposits that can adversely affect formation of a spark.

Accordingly, it is desirable to develop a low-cost ignition system that provides repeatable and responsive ignition triggering.

SUMMARY OF THE INVENTION

An ignition assembly comprises a power converter receiving an alternating current (hereinafter "AC") input for sustaining ionization and therefore spark formation within an ignition gap.

The example ignition assembly includes a first capacitor and a second capacitor that are operable to be charged in parallel to a first DC voltage and at a first polarity and to discharge in series to an output at a second DC voltage that is greater than the first DC voltage. The second DC voltage is coupled to the ignition gap, and causes the ignition gap to ionize and form a spark. A switch is coupled to the first capacitor and is operable to control the discharge of the first capacitor and the second capacitor. An AC input switch is coupled to the AC input and is operable to control a flow of current from the AC input through the first capacitor and the second capacitor to the output. The flow of AC to the output sustains the ionization of the ignition gap.

These and other features of the present invention can be best understood from the following specification and drawings, the following of which is a brief description.

DETAILED DESCRIPTION OF THE PREFERRED EMBODIMENT

Figure 1A:
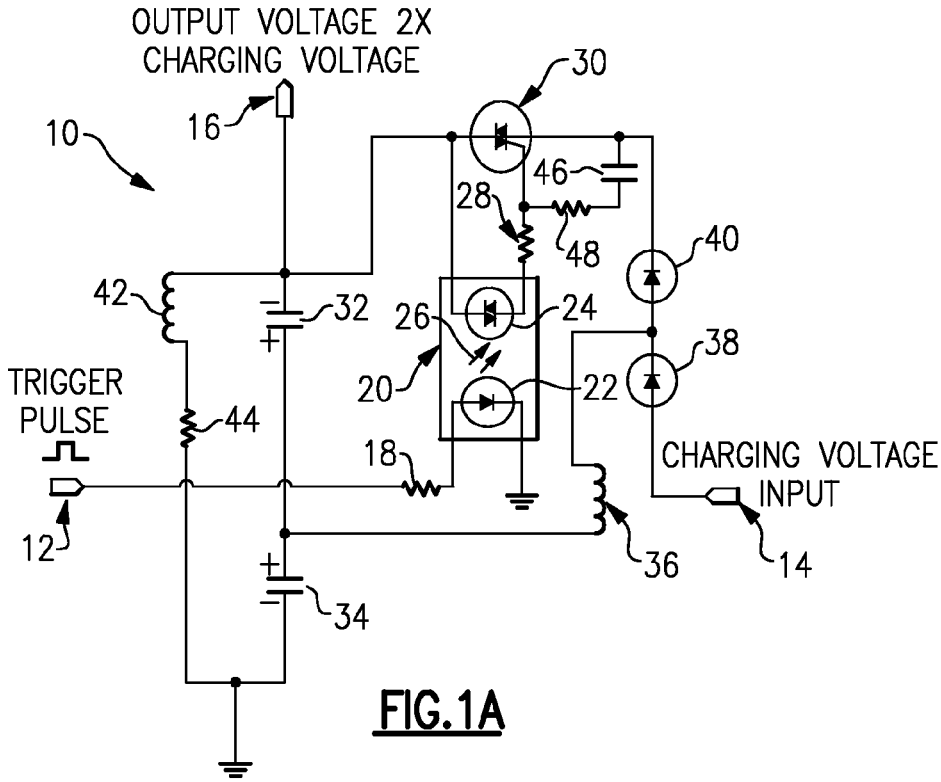
FIG. 1*a* is a schematic view of a single stage of an example power converter assembly, charged at a first polarity.

FIG. 1*a* illustrates a single stage of a power converter assembly 10. The assembly 10 receives an input pulse 12 and a charging input voltage 14. The converter assembly 10 increases the input voltage 14 to an output voltage 16 by a factor of 2×N, as represented by the equation:

$$V_{out}=V_{in}\times 2\times N \qquad \text{equation \#1}$$

where

"$V_{out}$" is the output voltage 16;

"$V_{in}$" is the input voltage 14; and

"N" is the number of stages.

FIG. 1*a* illustrates an example single stage where N=1.

The input pulse 12 provides electric current that passes through a current-limiting resistor 18 to an optocoupler 20. The optocoupler 20 comprises a light-emitting diode (LED) 22 and a diode for alternating current (DIAC) 24 that are electrically isolated from each other. The input pulse 12 turns ON LED 22 that emits light 26 that turns DIAC 24 ON. When DIAC 24 is ON, current flows through current-limiting resistor 28 to a gate of a triode for alternating current (TRIAC) 30, and turns TRIAC 30 ON, commutating DIAC 24 OFF. Although a TRIAC 30 is shown in FIG. 1, it is understood that other solid-state switches, such as silicon-controlled rectifiers, MOSFETs, or IGBTs could also be used.

Before TRIAC 30 turns ON, a first capacitor 32 and a second capacitor 34 are charged in parallel through an inductive winding 36. Current flows from the input voltage 14, through a diode 38, and then passes from winding 36 to the first capacitor 32 and the second capacitor 34. The orientation of diode 38 prevents the winding 36 from discharging back into the input voltage 14. The first capacitor 32 and second capacitor 34 are charged at a first polarity, and the polarity of capacitor 32 is the opposite of the polarity of capacitor 34.

Figure 1B:
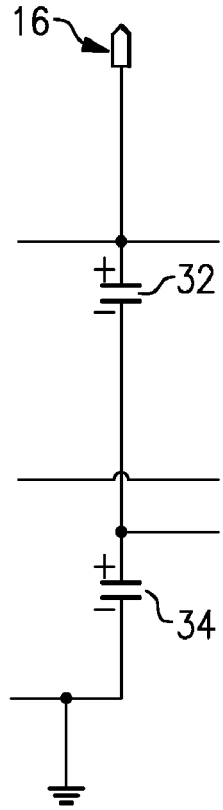
FIG. 1*b* is a schematic view of the example assembly charged at a second polarity opposite the first polarity.

When TRIAC 30 turns ON, current flows in a counter-clockwise direction from the first capacitor 32 to the winding 36, and energy is stored in a magnetic field associated with the winding 36. A voltage across the capacitor 32 then drops to zero. The magnetic field associated with the winding 36 then collapses and current flows in a counter-clockwise direction back to the capacitor 32 by passing through diode 40 and then through TRIAC 30. At this point, TRIAC 30 commutates OFF. As shown in FIG. 1B, capacitor 32 is then charged at a second polarity that is opposite the first polarity. At this point, capacitors 32 and 34 have the same polarity and are operable to discharge in series to the output voltage 16. This "charge pump" process then repeats to continuously provide voltage to a load (not shown). When the input pulse is at an OFF position, the assembly 10 recharges, and when the input pulse is at an ON position, the assembly discharges as a "charge pump." While FIG. 1*a* illustrates a high voltage direct current output, if a high voltage alternating current output is desired, an appropriate inverter could be used to perform such a conversion at the output of the converter assembly 10.

An inductive winding 42 is coupled in series to a resistor 44. Together winding 42 and resistor 44 provide a DC path to ground for charging capacitor 32. Winding 42 and resistor 44 also block AC from ground, as it is possible that AC may be present from winding 36. A diode 40 is used to block current from flowing in a clockwise direction from TRIAC 30 to winding 36 and to prevent energy loss during the charge pumping process at slower rise-times. A capacitor 46 is coupled in series to a resistor 48. The capacitor 46 and resistor 48 are in parallel with TRIAC 30, and are used to increase noise immunity in order to avoid false triggering of TRIAC 30.

Figure 2A:
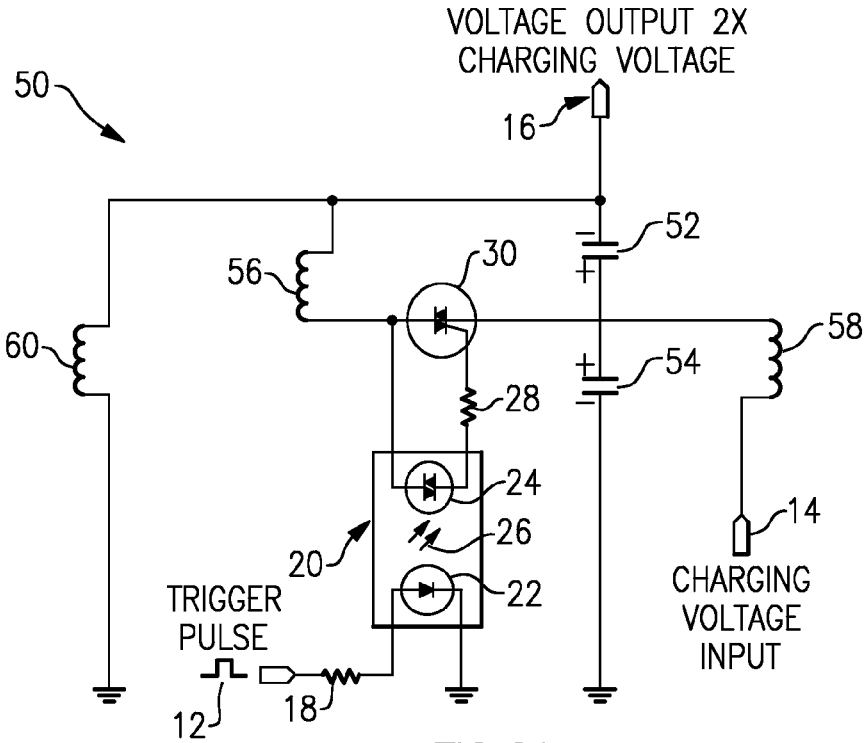
FIG. 2*a* is a schematic view of a single stage of another example power converter assembly, charged at a first polarity.

FIG. 2*a* illustrates a single stage of a second example power converter assembly 50. Components 12, 14, 16, 18, 20, 22, 24, 26, 28, and 30 operate as described above. Also, as in the previous embodiment, the converter 50 increases the input voltage 14 to an output voltage 16 by a factor of 2×N, as shown in equation #1.

Figure 2B:
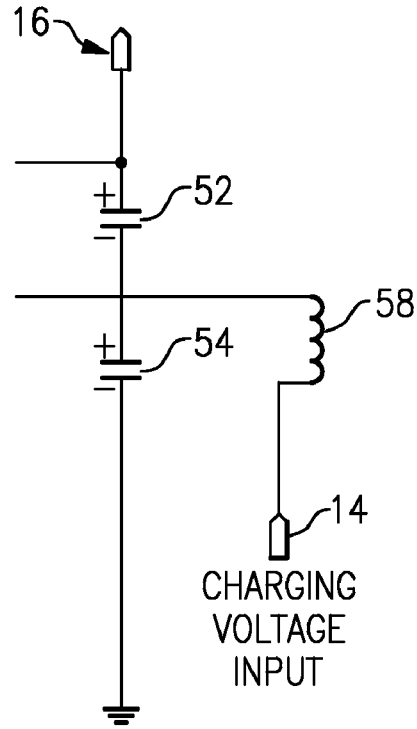
FIG. 2*b* is a schematic view of the example assembly of FIG. 2*a* charged at a second polarity opposite the first polarity.

A first capacitor 52 and a second capacitor 54 are charged to an initial voltage at an initial polarity. When TRIAC 30 commutates ON, current flows in a clockwise direction from the first capacitor 52 through TRIAC 30 to an inductive winding 56, and energy is stored in a magnetic field associated with the winding 56. A voltage across the capacitor 52 then drops to zero and TRIAC 30 commutates OFF. The magnetic field associated with the winding 56 then collapses and current flows in a clockwise direction back to the capacitor 52, charging the capacitor 52 at an opposite polarity, as shown in FIG. 2*b*. At this point, capacitors 52 and 54 have the same polarity and are operable to discharge in series to the output voltage 16. Additional inductive windings 58 and 60 provide the functions of blocking AC energy from DC ground, blocking AC energy from input voltage 14, blocking fast rise time output voltage from DC ground, and providing fast charging of capacitors 52 and 54. A rise time is the time it takes for a voltage at an output of a converter assembly to peak for a single charge pump. Although windings 58 and 60 are electrically separate and shown as separate components, it is possible that both windings 58, 60 could be wound on the same magnetic core.

The assembly 50 uses windings 58 and 60 instead of the diodes 38 and 40 of assembly 10. The example windings 58 and 60 provide a maximum impedance to AC during discharge, and thus result in little loss of current to ground. In addition, when the assembly 50 is charging, the magnetic fields of windings 58 and 60 are opposing and cancel, thus providing a minimum inductance and a minimum impedance to a charging current. This facilitates a faster charging time for capacitors 52 and 54, and results in a faster rise time. In addition, because no diodes are utilized in the circuit of FIG. 2*a*, reversal of stage polarity is possible by reversing charge voltage polarity.

Figure 3:
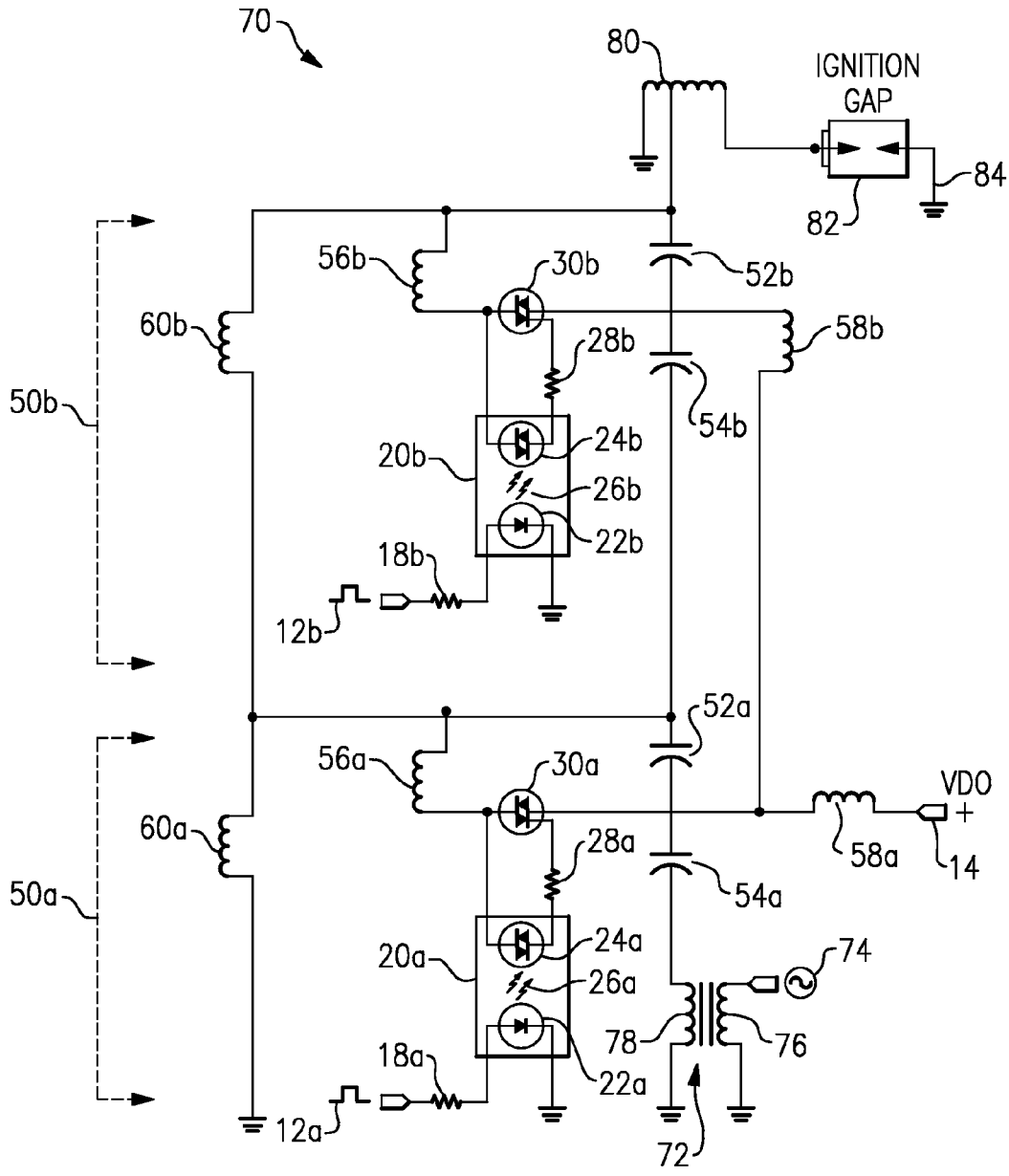
FIG. 3 is a schematic view of an example ignition assembly comprising the power converter assembly of FIG. 2*a*.

FIG. 3 illustrates how the converter assembly 50 of FIG. 2*a* can be cascaded to form an ignition assembly 70. The example ignition assembly 70 has a two stages 50*a* and 50*b*, however it is understood that other quantities of stages could be used. Using equation #1, since there are two assembly stages 50*a* and 50*b*, "N"=2, and the output voltage would therefore be four times greater than the input voltage. Thus, if the input voltage 14 is 300 volts, the output voltage would be 1,200 volts.

An input transformer 72 is coupled to an AC input 74 and to the switch 54*a*. In one example the transformer is a 1:1 transformer, which provides an AC output of a same magnitude as the AC input 74. However, it is understood that the input transformer could multiply the AC input 74 to provide an AC output of a greater magnitude than the AC input 74. The input transformer comprises a first winding 76 and a second winding 78. A voltage from the AC input 74 flows into the first winding 76 and induces an AC voltage in the second winding 78.

As described above, each stage 50*a*, 50*b* has an input pulse 12*a*, 12*b*. In one example the input pulses 12*a* and 12*b* are the same input pulse. The second stage 50*b* is coupled to an output transformer 80. In one example the output transformer is a 1:10 transformer, in which an output from the output transformer 80 is ten times greater than an input to the output transformer 80. The output transformer 80 is coupled to an ignition gap 82. In one example the ignition gap is a spark plug.

The DC output voltage from the power converter assembly stages 50*a* and 50*b* provides a DC voltage to the ignition gap 82 that ionizes the ignition gap to form a spark. AC from the AC input 74 induces AC to flow from the second winding 78 through the capacitors 54*a*, 52*a*, 54*b*, and 52*b* to the output transformer 80. AC then flows to the ignition gap to sustain the ionization of the ignition gap and maintain the spark formed in the ignition gap. Once the ignition gap 82 is ionized, an impedance of the ignition gap is lowered, which facilitates a flow of AC. The ignition gap is coupled to a ground connection 84. In one example the ground connection 84 is a cylinder head of an engine.

As mentioned above, windings 58*a*, 58*b*, 60*a* and 60*b* provide several functions: blocking AC energy from DC ground, blocking AC energy from the input voltage 14, blocking fast rise time output voltage from DC ground, and providing fast charging of capacitors 52*a*, 52*b*, 54*a* and 54*b*. In one example the windings 58*a*, 58*b*, 60*a*, and 60*b* are toroid windings with a higher inductance than a typical winding.

Figure 4:
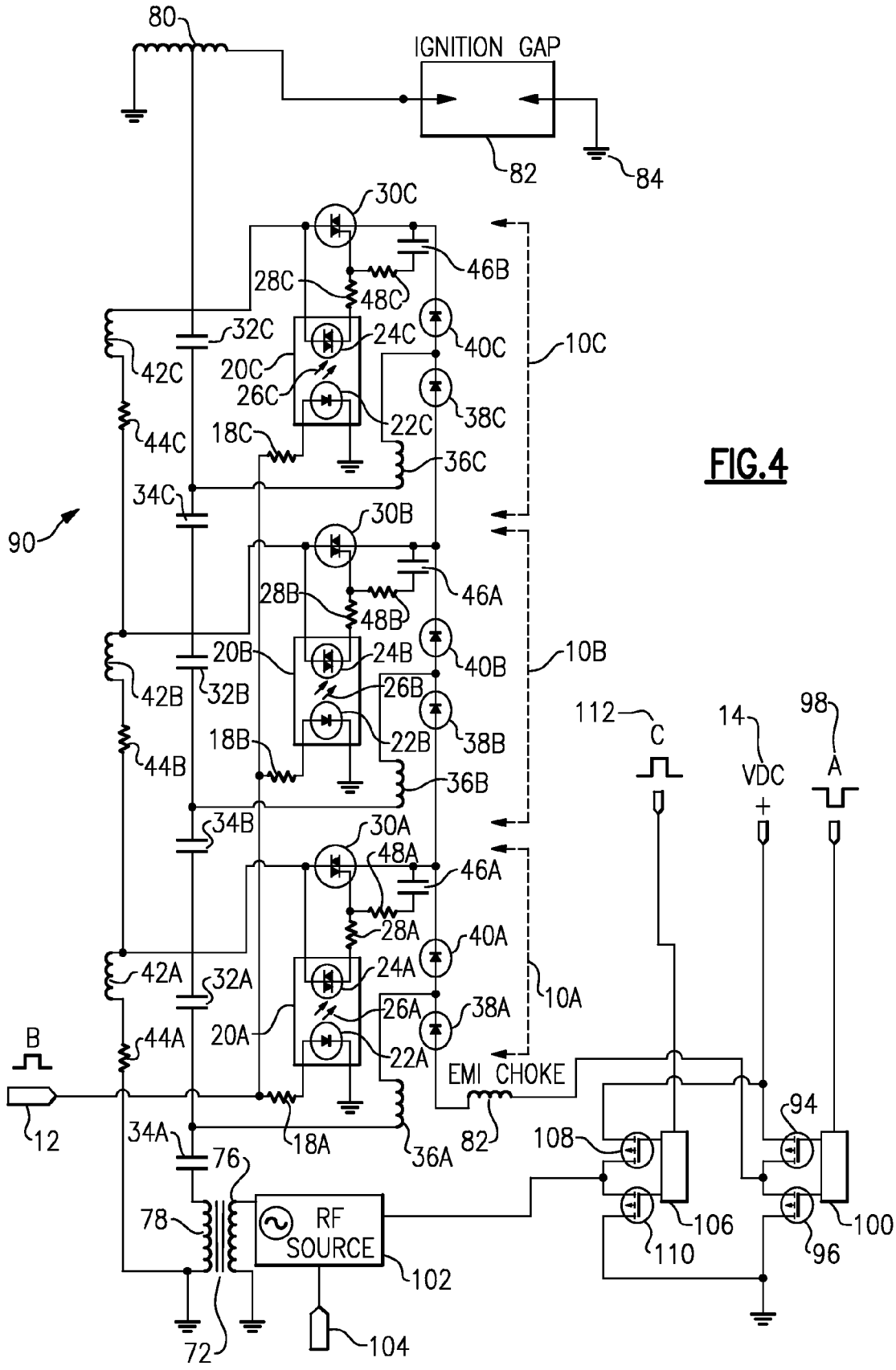
FIG. 4 is a schematic view of the example ignition assembly comprising the power converter assembly of FIG. 1*a*.

FIG. 4 illustrates the converter assembly 10 of FIG. 1*a* cascaded to form an ignition assembly 90. The example ignition assembly 90 has three stages 10*a*, 10*b*, and 10*c*, however it is understood that other quantities of stages could be used. Using equation #1, since there are three assembly stages 10*a*, 10*b*, and 10*c*, "N"=3, and the output voltage would therefore be six times greater than the input voltage. Thus, if the input voltage 14 is 300 volts, the output voltage would be 1,800 volts.

A choke 92 prevents switching noise from reaching the input voltage 14. MOSFETs 94 and 96 act as a first half bridge and turn ON and OFF the input voltage 14 so that the capacitors 32*a*, 32*b*, 32*c*, 34*a*, 34*b*, and 34*c* are not simultaneously being charged and discharged. Input pulse 98 activates a first gate driver 100 in order to turn MOSFETs 94 and 960N and OFF.

An RF source 102 provides an AC input, and provides high frequency AC to the input transformer 72. As previously mentioned, the input transformer 72 and the output transformer 80 can perform an amplification function, however it is also possible for them to be 1:1 transformers that do not amplify. A low voltage source 104 is coupled to the RF source 102 to power the RF source 102. A second gate driver 106 is coupled to MOSFETS 108 and 110. The MOSFETs 108 and 110 act as a second half bridge to turn ON and OFF a third input pulse 112. The third input pulse 112 with the gate driver 106 turns the RF source 102 ON and OFF.

The DC output voltage from the power converter assembly stages 10*a*, 10*b*, and 10*c* provides a DC voltage to the ignition gap 82 that ionizes the ignition gap to form a spark. AC from the AC input 74 induces AC to flow from the second winding 78 through the capacitors 34*a*, 32*a*, 24*b*, 32*b*, 34*c*, and 32*c* to the output transformer 80. AC then flows to the ignition gap to sustain the ionization of the ignition gap and maintain the spark formed in the ignition gap. Once the ignition gap 82 is ionized, an impedance of the ignition gap is lowered, which facilitates a flow of AC. The ignition gap is coupled to a ground connection 84.

The ignition assembly 90 has three input pulses 12, 98, and 112 which are timed to operate the ignition assembly 90. Input pulse 98 and input pulse 112 are synchronized to not simultaneously provide a voltage. Input pulse 98 first provides a current to gate driver 100 to charge all of the capacitors 32*a*, 34*a*, 32*b*, 34*b*, 32*c*, and 34*c* at a first polarity. Then input pulse 12 provides a current to the optocouplers 20*a*, 20*b*, and 20*c* to charge the capacitors 32*a*, 32*b*, and 32*c* at a second polarity opposite the first polarity. Input pulse 112 overlaps with input pulse 12 to then provide AC to the capacitors 32*a*, 34*a*, 32*b*, 34*b*, 32*c*, and 34*c*.

Figure 5:
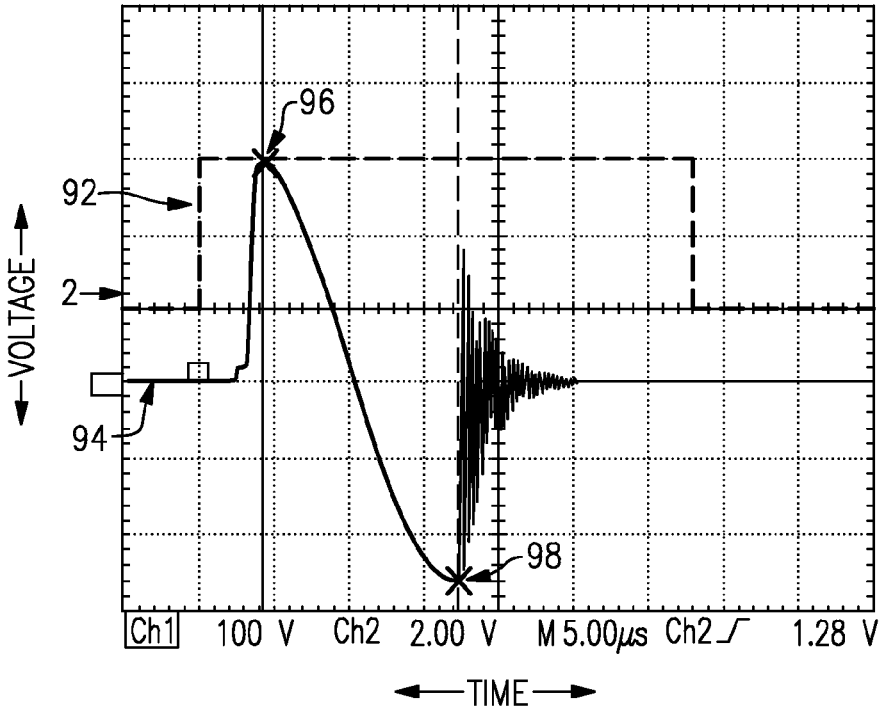
FIG. 5 is a graph illustrating an example relationship between a voltage across an inductive winding of a converter assembly as a function of time.

FIG. 5 is a graph that illustrates an example voltage 94 across a 44 uH inductive winding as a function of time. An input pulse 92 is illustrated by a dotted line. The increase in the voltage 94 corresponds to the formation of a magnetic field associated with the winding, and the decrease in voltage 94 corresponds to the collapse of the magnetic field associated with the winding. The rise and fall of the voltage 94 all occurs within one phase of the input pulse 92. Using the magnitude of the output pulse as a scale, marker 96 corresponds to 10% of the output pulse and marker 98 indicates 90% of the output pulse. As the voltage across the winding decreases, the voltage at the output increases, as indicated by markers 96 and 98.

As described above, an inductive winding first builds up a magnetic field and a voltage across the winding increases, and then the magnetic field collapses and the voltage across the winding decreases. The duration of this process is a "charge reversal time." A charge reversal can be calculated from the equation:

$$t=2\pi\sqrt{LC} \qquad \text{equation \#2}$$

where

"t" is the charge reversal time;

"L" is the inductance of a winding; and

"C" is the capacitance of a capacitor, or group of capacitors.

As shown in FIG. 5, equation #2 yields a charge reversal time of 13 microseconds.

Figure 6:
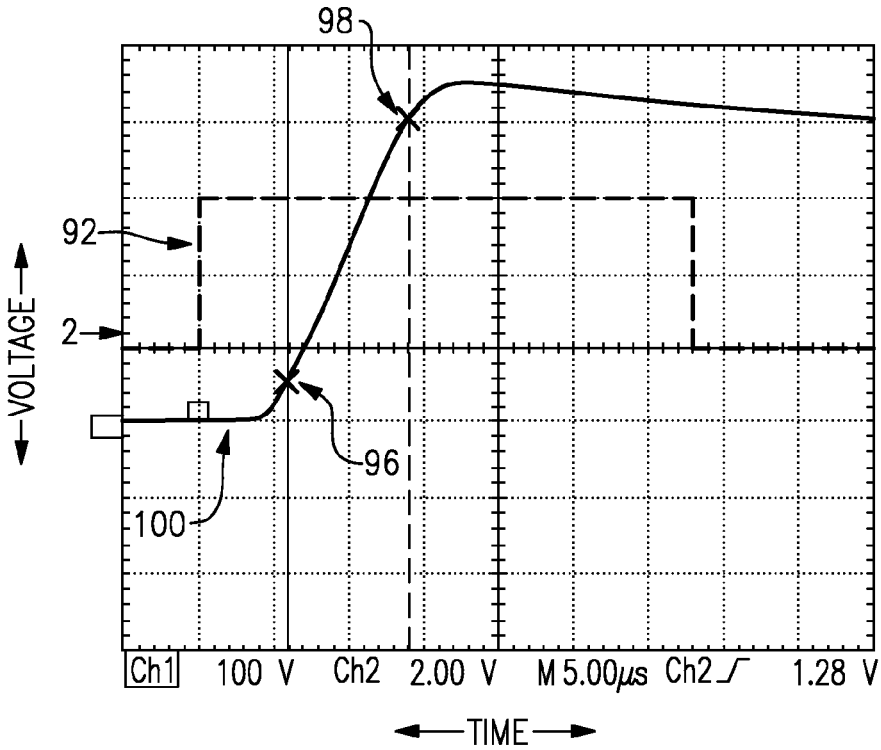
FIG. 6 is a graph illustrating an example relationship between a rise time of a voltage at an output of a converter assembly as a function of time.

A "rise time" is the time it takes for a voltage at an output of a converter assembly to peak for a single charge pump. The use of a solid state switch in a converter assembly facilitates rise times of less than 10 microseconds for an output voltage, and jitter less than 100 nanoseconds between pulses, even with simultaneous triggering of multiple stages. FIG. 6 illustrates a voltage 100 at an output of a converter assembly, using example values of a 0.47 uF capacitor and a 44 uH inductive winding. This yields a rise time of 8 microseconds. Notice that as in FIG. 5, the rise and fall of the voltage 100 occurs within one phase of the input pulse 92.

A charge pump energy balance can be calculated according to the equation:

$$(\tfrac{1}{2})LI^2=(\tfrac{1}{2})CV^2 \qquad \text{equation \#3}$$

where

"L" is inductance;

"I" is current;

"C" is capacitance; and

"V" is a charging voltage

Equation #3 enables one to estimate peak current ("I") from L, C, and V.

Figure 7:
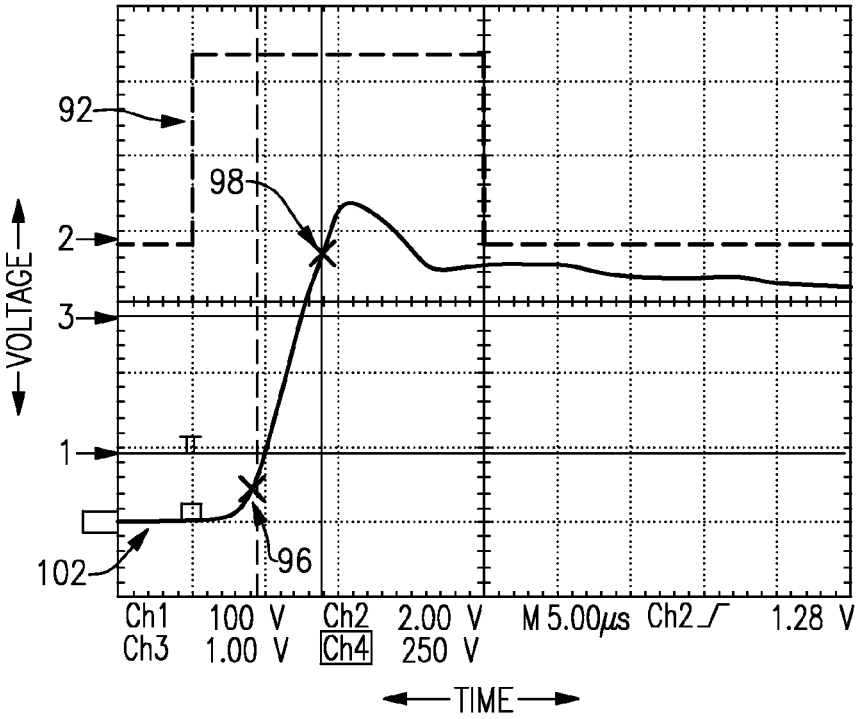
FIG. 7 illustrates a voltage across an inductive winding with a smaller inductance than the winding of FIG. 5 as a function of time.

FIG. 7 illustrates that, as predicted by equation #2, using a smaller inductor can decrease a charge reversal time and can therefore decrease a corresponding rise time for a converter assembly. Using a 0.47 uF capacitor and a 12 uH inductive winding, an output voltage 102 raises from its 10% value to its 90% value 98 in 4.5 microseconds, as compared to the 8 microsecond rise time of FIG. 6.

Figure 8:
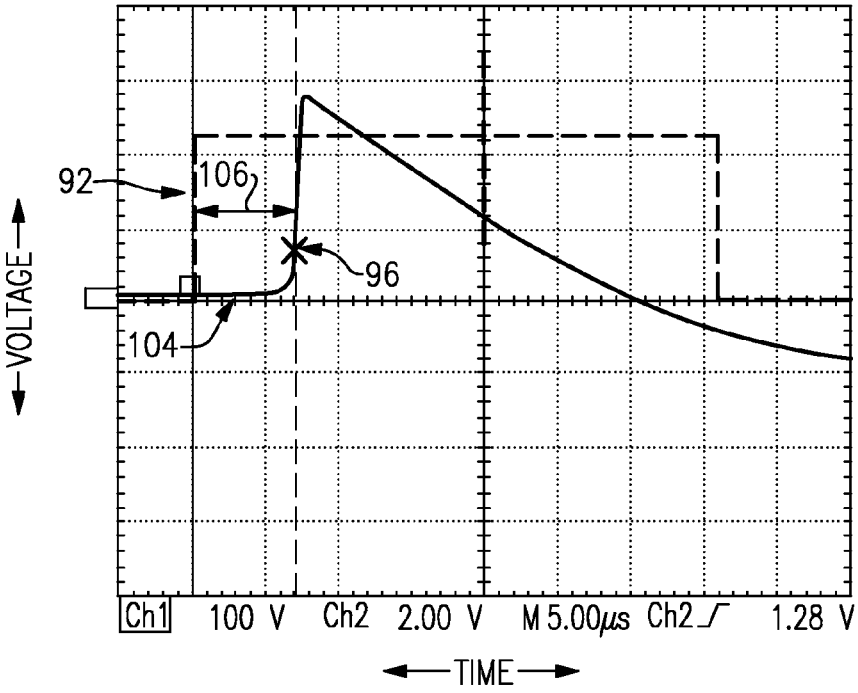
FIG. 8 illustrates a voltage at an output of a converter assembly as a function of time.

FIG. 8 illustrates a delay time of an example commercial TRIAC switch. From the increase in value of the input pulse 92 to the increase of an output voltage 104, there is a 2.8 microsecond delay 106. The cause of such a delay 106 can be attributed to upstream electronics.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An ignition assembly comprising:

a power converter, including:

a first capacitor and a second capacitor, wherein the first capacitor and the second capacitor are operable to be charged in parallel to a first DC voltage and at a first polarity and to discharge in series to an output at a second DC voltage that is greater than the first DC voltage;

a switch coupled to the first capacitor operable to control the discharge of the first capacitor and the second capacitor;

a first winding coupled to the first capacitor, wherein the switch facilitates the discharge of the first capacitor and the second capacitor by selectively discharging the first capacitor into the first winding, and wherein the first winding returns energy through the switch and to the first capacitor to charge the first capacitor at a second polarity opposite the first polarity so that the first capacitor and the second capacitor discharge in series; and an AC input switch coupled to an AC input that is operable to control a flow of current from the AC input through the first capacitor and the second capacitor to the output.

2. The ignition assembly of claim 1, wherein the power converter assembly includes a plurality of stages with a plurality of sets of first and second capacitors coupled in series, wherein each of the first and second capacitors are individually charged in parallel, and wherein the plurality of sets of first and second capacitors are collectively discharged in series to the output.

3. The ignition assembly of claim 1, wherein the output is coupled to an ignition gap and the power converter assembly discharges to the output to ionize the ignition gap, and the flow of current from the AC input sustains the ionization at the ignition gap.

4. The ignition assembly of claim 3, comprising an input transformer coupled to the AC input; and an output transformer connecting the output to the ignition gap.

5. The ignition assembly of claim 4, wherein the output transformer increases the second DC voltage to a third DC voltage that is greater than the second DC voltage.

6. The assembly of claim 5, including an input pulse, wherein the input pulse is coupled to the switch, and is operable to turn the switch ON and OFF.

7. The assembly of claim 6, including an optocoupler coupled to the input pulse and to the switch, wherein the optocoupler activates the switch responsive to the input pulse.

8. The assembly of claim 7, wherein the switch is a solid state switch.

9. The assembly of claim 1, comprising:

at least one diode coupled to a first DC input voltage;

a second winding coupled to a first resistor, wherein the second winding is coupled to the first capacitor and the first resistor is coupled to the second capacitor; and a third capacitor coupled to a second resistor, wherein the third capacitor and second resistor are coupled in parallel to the switch.

10. The assembly of claim 1, comprising:

a second winding coupled to the switch and to the first and second capacitors; and a third winding coupled to the first winding and to the first capacitor.

11. The assembly of claim 9, comprising:

a first gate driver coupled to an input pulse to control a DC input voltage; and a second gate driver coupled to an input pulse to control the AC input, wherein the AC input is a high frequency input.

12. A method of igniting an ignition gap, comprising the steps of:

a) charging a first capacitor and a second capacitor in parallel to a first voltage and at a first polarity;

b) discharging the first and second capacitor to an output at a second voltage that is greater than the first voltage to ionize an ignition gap, the discharging step including using a switch to discharge the first capacitor into an inductor so that the inductor returns energy through the switch and to the first capacitor to charge the first capacitor at a second polarity opposite the first polarity so that the first capacitor and the second capacitor discharge in series at a second voltage; and c) directing a flow of AC through the first and second capacitors to the output to sustain the ionization at the ignition gap.

13. The method of claim 12, wherein step a) comprises individually charging a plurality of sets of first capacitors and second capacitors in parallel, and wherein step b) comprises collectively discharging the plurality of sets of first capacitors and second capacitors in series to the output.

14. The method of claim 12, wherein the output comprises an output transformer that converts the second voltage to a third voltage that is greater than the second voltage.

15. The method of claim 12, wherein the AC input comprises a radio frequency source coupled to an input transformer.

* * * * *